United States Patent [19]

Bonassi

[11] Patent Number: 4,479,453

[45] Date of Patent: Oct. 30, 1984

[54] ROLLER FAIR-SHEET FOR BOAT SAILS MANENVERING

[76] Inventor: Luciano Bonassi, Via Filippo Reina 33, 21047 Saronno (Varese), Italy

[21] Appl. No.: 427,267

[22] Filed: Sep. 29, 1982

[30] Foreign Application Priority Data

Oct. 15, 1981 [IT] Italy ..... 24502 A/81

[51] Int. Cl.[3] ..... B63B 21/04

[52] U.S. Cl. ..... 114/218; 254/395

[58] Field of Search ..... 254/394, 409, 415, 395; 114/218, 179, 181

[56] References Cited

U.S. PATENT DOCUMENTS

| | | | |
|---|---|---|---|
| 279,985 | 6/1883 | Sharrett | 254/415 |
| 928,766 | 7/1909 | Johnstone | 114/218 |
| 3,407,011 | 10/1968 | Zeidler | 254/395 |

FOREIGN PATENT DOCUMENTS

| | | | |
|---|---|---|---|
| 244263 | 9/1960 | Australia | 254/400 |
| 735750 | 6/1966 | Canada | 254/400 |

*Primary Examiner*—Trygve M. Blix
*Assistant Examiner*—Jesûs D. Sotelo
*Attorney, Agent, or Firm*—Michael J. Striker

[57] ABSTRACT

A roller fair-sheet of the type including a mounting with a frame, which is articulated to such mounting by way of a pin and at least three revolving horizontal rollers arranged parallel to each other and transversal to the sheet path in such a way that their envelope provides a cylindrical surface of circular section with small curvature or conic section with great curvature, and the central roller axis preferably coincides with the axis of the articulated pin, while the lateral rollers can translate in space moving parallelly to the axis of the central roller, keeping constant the curvature of the conic section.

6 Claims, 4 Drawing Figures

ROLLER FAIR-SHEET FOR BOAT SAILS MANENVERING

SUMMARY OF THE INVENTION

The present invention refers to a roller fair-sheet of the type including a mounting with a frame, which is articulated to such mounting by means of a pin and at least three revolving horizontal rollers, parallel to each other and transversal to the sheet path.

Said rollers are positioned in such a way that their envelope provides a cylindrical surface of circular section, or more generally of small curvature conic section or, whish is the same, of great curvature radius. The cnetral roller axis, preferably, coincides with the axis of the articulated pin, while the lateral rollers can translate in space moving parallely to the axis of the central roller, keeping constant the curvature of said conic section.

DESCRIPTION OF THE INVENTION

The present invention refers to a roller fair-sheet which has a mounting and a mobile frame, articulated by means of a pin to said mounting, including at least three revolving horizontal rollers, parallel with respect to each other and perpendicular to the sheet path. These rollers are so positioned that their envelope creates a cylindrical surface, circular in section, or more generally having a small curvature conic section. In the following description, these rollers will be simply called, for clarity sake, transversal rollers.

Fair-sheets are devices suitable to lead the sheets under stress, when maneuvering the boat sails, in such a way as to force the sheets themselves, which come from the sails with a certain slant, into a direction parallel to the boat deck in order to ease their winding and finally their throttling around a winch.

Known fair-sheets are generally constituted of a stirrup whose two arms support a strong turnable transversal roller, under which runs the sheet to be pulled. Said stirrup may either form only one body or be articulated to a sliding block running on a positioning rail.

What is important in fair-sheets is that this transversal roller be of a rather large diameter in order to offer to the sheet under stress a limited curvature thus limiting the tension stresses of the sheet itself.

Moreover, it is necessary that the distance between the lower edge of the roller and the underlying sliding block be kept within acceptable limits, in order to avoid that the remarkable stress exerted on the sheet originates a moment on the rail, which could cause the twist or even the breakaway of the sliding block.

It also must be added that the device dimensions must be limited both for practical reasons and for limiting its cost: one can easily understand how these requirements are not compatible within the extisting fair-sheets.

The fair-sheet of the present invention succeeds in realizing the equivalent of a roller having a considerable diameter while keeping limited its overall dimensions and keeping also limited the distance between the lower edge of such equivalent roller and the underlying sliding block.

To reach such goals, the fair-sheet of the present invention is characterized by the fact that it includes a mounting which, in one piece, forms a sliding block suitable for running on a rail and a stirrup whose arms are consituted by two plane vertical walls, directed upward; a mobile frame articulated by means of a pin to said mounting, also provided with two plane vertical sides which, in coupling, position themselves internally to the stirrup's arms; at least three rollers, parallel, transversal, revolving on pins, included between the two sides and disposed in such a way as to offer to the passing sheet a support arc of small curvature. The whole is arranged in such a way that the sheet, which normally is directed downward with a certain slant, when reaching the first roller, determines a rotation of the mobile frame around said articulation pin, so that the sheet itself may lay in all cases on the whole transversal roller, thus equally distributing the stresses. Said small curvature arc may be an arc of circumference or more generally an arc of a conic. In a preferred form, the rotatory movement of the frame which carries the rollers is obtained by the coincidence of the median roller pin with the articulation pin of the mobile frame, while the pins of the other rollers are fastened to the walls of said mobile frame, whose movement they follow rigidly.

On said mobile frame, on the sheet entrance side, are placed, in correspondence to the frame sides and restrained to them, two auxiliary rollers having axis mutually parallel and skew perpendicular to the axis of said transversal rollers. Finally, the frame is provided with a further small transversal roller connecting the bearing basements of said auxiliary rollers.

The whole arrangement is intended to ease the sheet entrance and avoid possible rubbing of the sheet either against the fixed lateral or the base walls of the device.

The object of the invention is shown, purely as an example and therefore not limiting other possible embodiments, in the enclosed drawings where:

Figure 4:
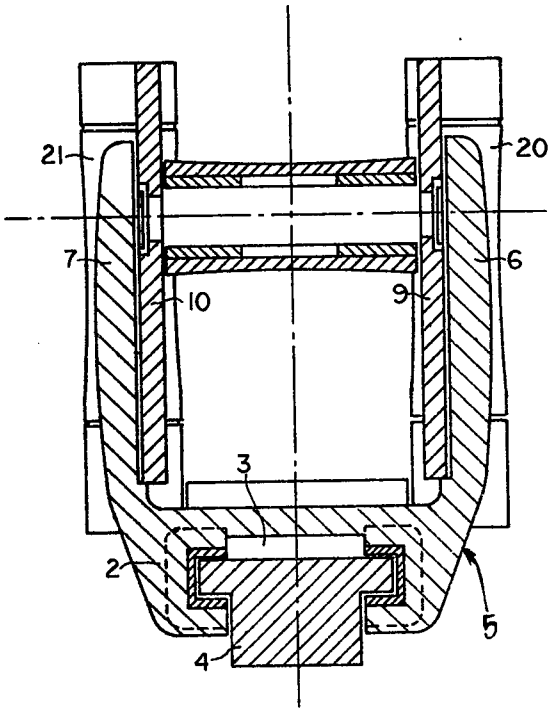
FIG. 4 is a section according to line IV—IV of FIG. 2, including the sliding rail.

With reference to such figures, the roller fair-sheet of the present invention includes a mounting 1 in one piece, which in its lower part, is shaped to form a sliding block 2, provided with a groove 3 having a C section looking downward, which enables it to run along a strong rail 4 (see FIG. 4) without the possibility of disengaging transversally.

In its upper part, mounting 1 forms a stirrup 5 having two plane and parallel sides 6 and 7 tapering upward. Inside said mounting 1 is placed a mobile frame, which as a whole is indicated by reference number 8, composed of two plane, parallel sides 9 and 10, which are placed with a certain slack internally to the respective walls 6 and 7 of stirrup 5.

The mobile frame 8 is articulated with respect to mounting 1, by means of a pin 11 (visible in the section of FIG. 1) which crosses sides 9 and 10 of said frame and is fastened at its extremities to walls 6 and 7 of stirrup 5 by means of the two heads 12 and 13 respectively.

Figure 1:
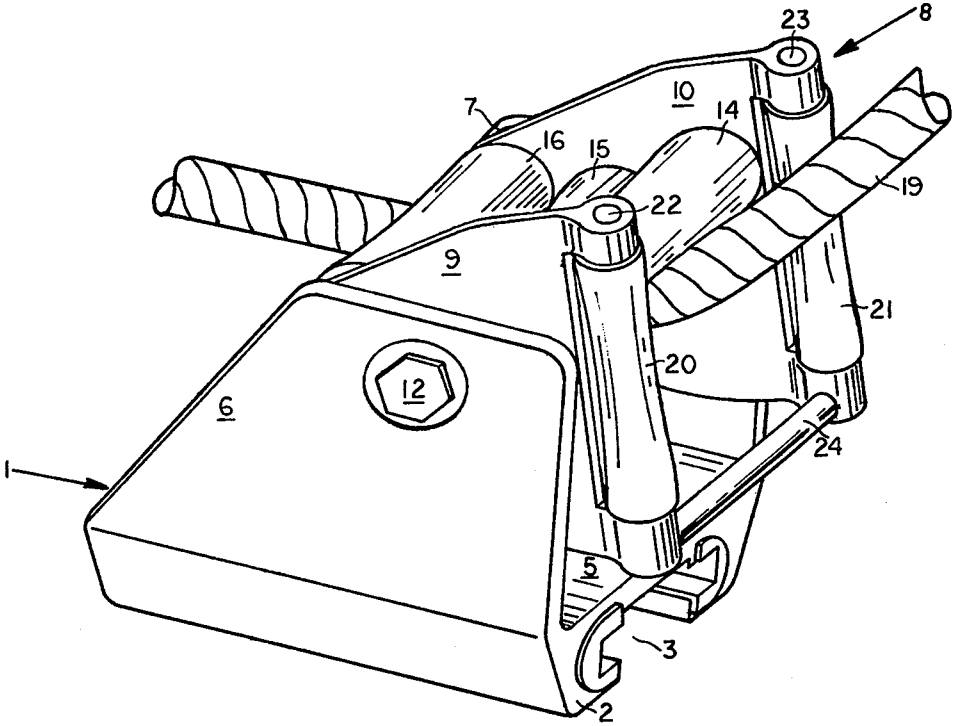
FIG. 1 is an axionometric view of the fair-sheet according to the present invention, showing the mobile frame a little bit lifted with respect to the mounting.
Figure 2:
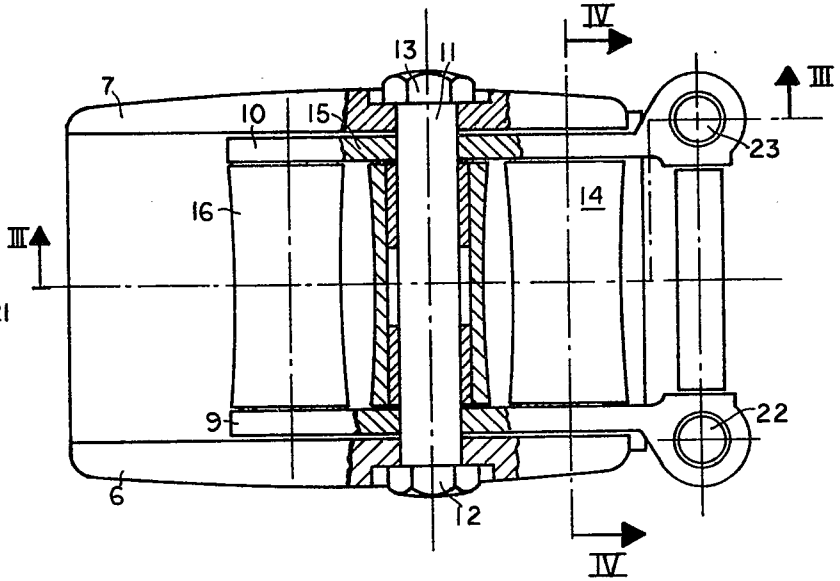
FIG. 2 is a plan view, partially in section, of the fair-sheet of FIG. 1.
Figure 3:
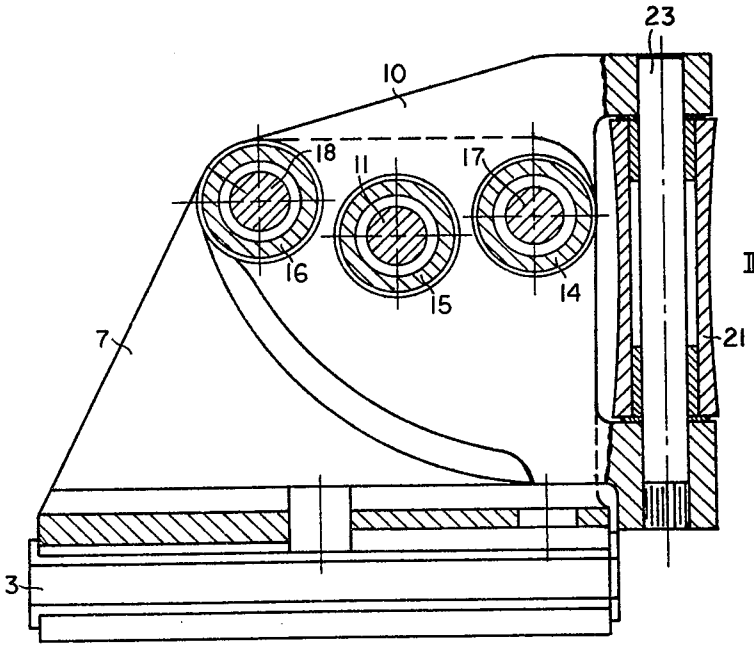
FIG. 3 is a section in elevation taken according to line III—III of FIG. 2.

With reference to FIGS. 1, 2 and 3, it may be noted that between the sides 9 and 10 of frame 8 are placed three transversal rollers 14, 15 and 16 (the number of rollers, however, may be different from the number indicated) having about the same diameter and axis perpendicular to these sides such rollers are placed in such a way that the envelope of their countour determines in the plane of FIG. 3 an arc of circumference or an arc of a small curvature conic (i.e. an arc having a high curvature radius), so as to offer to the sheet under stress a wide arc of support, thus better distributing the stresses. In fact they are a valid substitute for the solution with only one large diameter roller which would require unacceptable dimensions for the fair-sheet.

In the preferred form of embodiment indicated in the enclosed drawings, the central roller 15 can rotate around said pin 11 where is articulated the mobile frame which, once fixed the fair-sheet on the sliding rail 4, remains constantly in the initial position, while lateral rollers 14 and 16 can rotate around their respective pins 17 and 18, whose extremities are fixed to the frame 8 and therefore can move together such frame, translating their axis parallely to the axis of said central roller and maintaining, constant in any case the curvature of the fair-sheet support arc.

It is evident that in a different form of embodiment of the invention, the articulation pin of the mobile frame may not coincide with any pin of said transversal rollers.

On the entrance side of sheet 19 and in correspondance of the fore part of the mobile frame 8 sides, are placed two rollers 20 and 21 having raised and parallel axis, spaced between themselves as much as said sides and covering the entire entrance height, so that sheet 19 can run easily between them.

Rollers 20 and 21 rotate around respective pins 22 and 23 whose extremities are restrained to just existing on said sides 9 and 10 of frame 8.

Axis of pins 22 and 23 result perpendicular to the axis of transversal rollers 14, 15 and 16. With such an arrangement, sheet 19, running beneath said transversal rollers, when is slanted with respect to median plane of rail 4, lays on either one of rollers 20 and 21, which rotate under the stress of the sheet itself, thus easing its sliding and leading it towards the transversal rollers.

Again, on the entrance side of sheet 19 and between the support base of said rollers 20 and 21, is provided a further small transversal roller 24 suitable to prevent the rubbing of the sheet itself against the base of stirrup 5.

The sheet under stress coming from the sail with a certain slant with respect to the horizontal plane, once overcome the lateral entrance rollers 20 and 21, gets in touch with roller 14, the first one of the transversal rollers series, pushing it upward (see FIG. 1). This movement of roller 14 causes the rotation of the mobile frame around pin 11 and, as a consequence, the lowering of roller 16 restrained to such frame, while roller 15, which can rotate around pin 11, remains in the initial position and therefore the envelope conic maintains constant its curvature.

The translation of the axis of transversal lateral roller 14 and 16 with respect to the axis of the central roller 15 permits to the sheet to lay, in any case, on all these transversal rollers, distributing on each roller the pulling stresses irrespective of the incoming direction and slanting of the sheet itself.

Moreover, due to the limited distance between rail 4 and the lower part of the closest roller, the lever arm, with respect to said rail, of the transversal components of the forces generated by the sheet stress, will be greatly reduced so that rail 4 receives a remarkably reduced momentum, thus reducing the overall stresses.

Naturally the invention is not limited to the example illustrated and is liable to all additions and variations which could favourably be included when practically emboding the invention, not necessarily outgoing from the present invention scope by doing so.

I claim:

1. Roller fair-sheet for boat sails maneuvering, characterized by a mounting which, in one piece, forms a sliding block suitable for running on a rail and a stirrup whose two arms are constituted of two plane, vertical walls upwardly directed; a mobile frame, articulated by means of a pin to said mounting, also having two plane vertical sides which are fastened internally to said stirrup arms; at least three transversal rollers which can rotate around pins placed between said walls and arranged in such a way as to offer to a passing sheet a small curvature support arc, so that the sheet, which comes generally downward with a certain slant, entering a first one of said rollers, causes a rotation of the mobile frame around said articulation pin, thus permitting the sheet itself to lay in any case on all the transversal rollers in order to get a more uniform distribution of the stresses developed by said sheet.

2. Roller fair-sheet, as in claim 1, where said small curvature support arc is an arc of a circle.

3. Roller fair-sheet, as in claim 1, where the rotatory movement of the frame, which carries the rollers, is obtained by the coincidence of the pin of one of the transversal rollers with the mobile frame articulation pin, while the pins of the other rollers are restrained to the walls of said mobile frame of which they follow the movements.

4. Roller fair-sheet as in claim 1, wherein on said mobile frame and on the sheet entrance side are placed, in correspondence of the sides of the frame itself and restrained to these sides, two auxiliary rollers, having axis parallel to each other and perpendicular to the axis of said transversal rollers and a further small roller connecting the support bases of said auxiliary rollers, the whole arrangement easing the sheet entrance and avoiding possible rubbing of the sheet itself against the lateral walls and the base of the frame.

5. Roller fair-sheet as in claim 1 where said stirrup and relevant block sliding over the rail are mutually articulated in order to form the mounting of the frame.

6. Roller fair-sheet, as in claim 1, where said small curvature support arc is an arc of conic.

* * * * *